United States Patent [19]

Karsen

[11] 4,024,807

[45] May 24, 1977

[54] PRESS

[75] Inventor: Douglas E. Karsen, Three Rivers, Mich.

[73] Assignee: Weldun International, Inc., Bridgman, Mich.

[22] Filed: Jan. 2, 1976

[21] Appl. No.: 646,058

[52] U.S. Cl. ..... 100/53; 72/455; 83/529; 100/214; 100/257; 100/292

[51] Int. Cl.[2] ..... B30B 15/04

[58] Field of Search ..... 72/455; 83/701, 859, 83/DIG. 1; 74/581, 583; 192/150; 100/53, 214, 231, 257

[56] References Cited

UNITED STATES PATENTS

| | | | |
|---|---|---|---|
| 2,092,092 | 9/1937 | Sinclair | 100/214 X |
| 2,522,450 | 9/1950 | Johansen | 100/53 X |
| 2,616,543 | 11/1952 | Danly | 100/53 X |
| 3,030,879 | 4/1962 | Lasko | 100/214 X |
| 3,247,783 | 4/1966 | Hammor | 100/214 |
| 3,400,625 | 9/1968 | Wrona | 100/257 X |

FOREIGN PATENTS OR APPLICATIONS

| | | | |
|---|---|---|---|
| 2,043,619 | 3/1972 | Germany | 100/214 |
| 581,753 | 8/1933 | Germany | 100/214 |

*Primary Examiner*—Billy J. Wilhite

*Attorney, Agent, or Firm*—Gordon W. Hueschen

[57] ABSTRACT

The invention is directed to a press having a crown member and a base member with support and tiedown means for maintaining the crown member at an operative predetermined work station relative to the base member, and operative press ram means operating between the crown and base means in direct or offset loading position on a workpiece, characterized in that the support and tiedown means comprises hollow columns characterized by greater resistance to the bending forces induced by offset loading than support and tiedown means comprised of solid columns composed of the same kind and amount of material as the hollow columns. These columns furthermore may comprise pressure fluid-actuated cylinders having cooperating pistons and piston rods. By rigidly affixing the base of these cylinders to one of the crown and base members and the free ends of the piston rods to the other, actuation of the piston rods to the outward throw or extended position moves the crown member away from the base member, and actuation to the inward throw or retracted position causes it to move toward the base member and, when so fully actuated, holds the crown member immovably at the predetermined work station. The hollow cylinders should optionally have a relative large length to breadth ratio and a relatively large bore.

37 Claims, 14 Drawing Figures

104
106
110
108
5.
12
84a
84b
114
114
114
114
98
66
92
66
52
112
112
62
112
52
34
94
94
48
48
30
90
90
30
3.
28
3.
28
21
38
36
38
36
50
10
5.

10.
106
104
9.
12
110
10.
140
108
126
98
130
118
64
66
66
52
34
52
116a
116b
90
48
90
48
28
20
9.
28
28
30
21
36
10

PRESS

BACKGROUND OF THE INVENTION

Field of Invention

The invention relates to a press adapted to carry out a pressure operation on a workpiece, either to deform it, cut it, or shape it. Such presses ordinarily comprise a base member and a crown member with two bolsters or pressure plates, one which is stationary and the other one of which is movable to and away from the other one by operative press ram means which optionally may be carried either by the crown member or by the base member.

PRIOR ART

It has long been known to make such presses, and similar devices, with their crown member and base member adjustable relative to each other with adjustable stop means for determining the spacing between them. See, for example, U.S. Pat. Nos. 458,650; 1,827,558; 2,092,092; 2,356,796; and 2,850,966. It has also long been known to use hydraulic means to hold a crown member in relative work relation to a base member. See, for example, U.S. Pat. No. 860,009 and German Patent No. 581,753. More recently a device of this general type as disclosed in U.S. Pat. No. 3,400,625 integrates various features of the known prior art into a more sophisticated press that uses hydraulic means to hold the crown member at its work station and to move it away therefrom. As in the early prior art, the tie and support rods of the press are connected to a hydraulic means and have adjustable collars thereon to support the crown member at its work station. The portions of the tie-rods which extend above these collars serve as guide members for guiding the crown member in its up and down motion and the portions below serve as support columns for supporting the crown member at its predetermined work station. Actuation of the hydraulic means causes the crown member to seat against th adjustable collars and the tie-rods function as support columns, as guide members for the crown member, as piston rods, and to hold down the crown member firmly upon the supporting columns. The advantage of having single rods serve the multiple purpose of support columns, tie rods, guide members, and piston rods is offset by the fact that such rods offer less than the desired amount of resistance to the bending moment induced by offset loading of the press and by the excessive number of wear surfaces. Thus, the support columns, being solid rods, are subject to bending which, however slight it may be, is sufficient to have a deleterious effect where precision press operations are involved. Also, the sliding contact between the guide members and the crown member, as well as the large number of slide fitted parts in the hydraulic means, multiples the number of wear surfaces.

OBJECT OF THE INVENTION

It is an object of the invention to provide a press which obviates the disadvantages of the prior art. It is a further object of the invention to provide a press having support and tie columns adapted to resist bending induced by offset loading of the press. A further object of the invention is to eliminate the necessity for guide members and thus eliminate wear surfaces. Other objects will appear as the description proceeds.

SUMMARY OF THE INVENTION

The invention is directed basically to a press having a crown member, a complementary base member, operative press ram means operating between said crown member and base member to apply work pressure to a workpiece in direct or offset loading position, and support and tiedown means adapted rigidly and immovably to hold said crown member at a predetermined work station with respect to the base member, characterized in that the support and tiedown means comprises hollow columns, whereby when pressure is applied to the workpiece in offset loading position, the columns afford greater resistance to the bending moment induced by the pressure on the offset loaded workpiece than the same amount of material would if it were in a solid column.

By offset loading position is meant that condition in which the work is effected at a position which is one side or the other of the center line of the press, i.e., a position which is not in vertical alignment with the drive shaft operating the movable bolster or pressure plate. To obtain optimum resistance to this type of force, each hollow column should have a relatively small ratio of length to minimum breadth. Also, it should have a relatively large bore. While the length to breadth ratio and the bore size can be varied widely within the scope of the invention, it is of advantage to have the ratio of length to minimum breadth not more than 5, and preferably between about 3 and 4, and a bore size such that the minimum wall thickness of the hollow column is between about 10 and about 25 percent of the bore diameter, or in other words, the bore is preferably between at least about ⅔, and about ⅞, of the minimum transverse dimension or diameter of the hollow column. Advantageously, the columns are square and the bores are circular in cross-section. Either, however, may have other shapes although preferably the cross-sections are those of right polygons of which the circle may be considered the ultimate, i.e., a right polygon having an infinite number of sides.

In accordance with a preferred embodiment of the invention, the hollow support and tiedown columns are the cylinders of a pressure fluid-actuated means which comprise a cylinder and cooperating piston and piston rod and are integrated for concurrent and equal action. Each of said pressure fluid-actuated means has the base of its cylinder rigidly affixed to one of the members, that is, one of the crown or base members, and the free end of its piston rod rigidly affixed to the other of said members. Advantageously, the base of the cylinder is attached to the base member and the free end of the piston rod is attached or affixed to the crown member. Also, there are provided cooperating pressure fluid inlet and outlet means and pressure fluid controls for effectively altering the pressure on either side of the piston. Thus, when the piston rods are actuated to their extended position, the crown member is moved away from the base member, and when the piston rod is actuated to its retracted position, the crown member is moved toward the base member and held in a fixed rigid position relative thereto determined by the limit of the retracted position of the piston rod.

Desirably, adjustable stop means is provided for adjusting the retracted position of the piston rod whereby the extent to which the crown member can move toward the base member is limited and correspondingly adjustable. Advantageously, the adjustable stop means comprises a collar affixed to the member to which the piston rod is affixed, is adjustable relative thereto, and has a surface adapted to abut the top of the cylinder or which is affixed to the top of the cylinder, is adjustable to and away therefrom, and has a surface adapted to abut the member to which the piston rod is attached. The piston rod projects through the collar and has a slide fit therewith. Advantageously, the stop means, including the collar and abutting surface, has a size and shape which is complementary to that of the top of the cylinder, such that when the piston is retracted the collar abuts the top of the cylinder and covers the major portion of the surface of the top of the cylinder, thereby giving a firm or solid support for the crown member.

In a preferred embodiment, the crown member has mounted in it operative press ram means affixed to a moveable bolster or pressure plate adapted to function in opposition to a fixed bolster or pressure plate attached to the base member. As the operative press ram means is operated, the movable bolster or pressure plate reciprocates back and forward toward the fixed bolster or pressure plate and causes pressure to be applied to a workpiece through tool means, such as dies, punches, cutters, etc., complementary parts of which are carried by the apposed bolsters or pressure plates.

Presses constructed in accordance with the invention have the advantage of providing hollow supporting columns which afford greater resistance to bending moments induced by pressure on an offset work load than would occur if the same kind and amount of material were formed into solid supporting columns. Also, such presses eliminate the need for guide members or rods for guiding the crown member in its motion to and away from the supporting columns. In presses according to the invention, the crown member is supported on the cylinders of pressure fluid-actuated means and the crown member is lifted away from the support columns as the piston rods are actuated to their extended position. The piston rods simply move the member to which they are rigidly attached away from the cylinder. Thus, if the cylinders are rigidly affixed to the base member and the piston rods rigidly affixed to the crown member, actuation of the piston rods to the extended position simply lifts the crown member off the cylinder support members, and actuation to the retracted position firmly seats the crown member on the top of the cylinders. Thus, wear surfaces between guide members and the crown member are entirely eliminated and the wear surfaces are confined to those involved in the pressure fluid-actuated means, and these are held to a minimum by the use of a single double-acting piston in each of the cylinder support members.

DETAILED DESCRIPTION OF THE INVENTION

Figure 1:
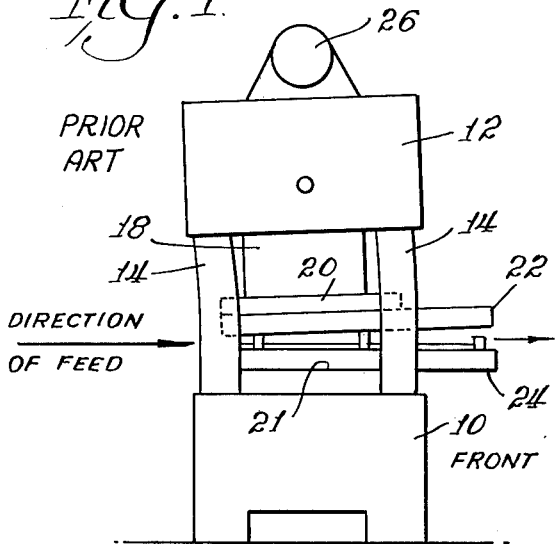
FIG. 1 is a side elevation of a press according to the prior art, showing, in exaggerated form, the bending induced in the tie rods or supporting columns in an offset loaded press.
Figure 2:
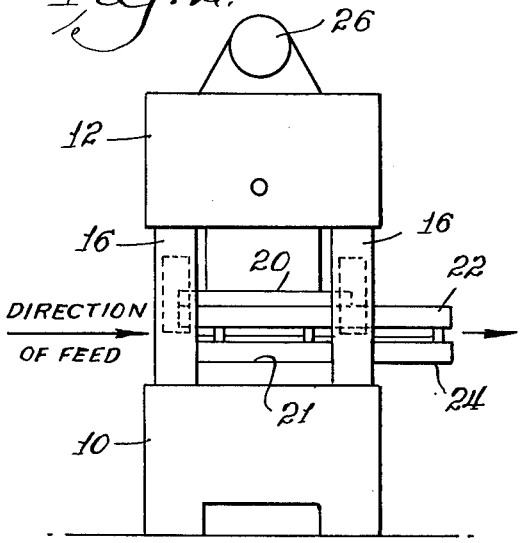
FIG. 2 is a side elevation of a press in accordance with the invention, illustrating how hollow support columns, in accordance with the invention, reduce the bending induced by offset loading of the press.

Referring now more particularly to FIGS. 1 and 2, there is shown in outline form two presses comprising base members 10 and crown members 12 supported on columns which in FIG. 1 are solid rods 14 functioning as both tie rods and support columns and in FIG. 2 hollow columns 16 which function both as tie rods and support columns. In both modifications, the members 14 and 16 are square in cross-section and function to hold the crown member in operative work station with regard to the base member 10.

The crown member 12 is provided with an operative press ram means 18 adapted to reciprocate to and away from the base member. At the base of the ram means 18 is an upper bolster or pressure plate 20 and apposed thereto is a lower bolster or pressure plate 21 supported on the upper surface of the base member 10. Supported by the upper and lower bolsters are complementary parts 22 and 24 of a tool means for operating on a workpiece. At 26 is shown, diagramatically, drive means for causing reciprocation of the press ram means 18.

The tool means 22 and 24 is shown projecting laterally from the press to illustrate the effect of offset loading. This is a common type of operation when a thin strip of material is fed from the back of the press to the front, that is, the strip is fed in a transverse motion to the centerline or axis of the press. The die means is constructed to perform a series of progressive operations on the strip and the die means projects beyond the front of the press, sometimes as much as several feet. The operation at 23 represents an offset loading position and provides a fulcrum to induce the bending moment illustrated. Sometimes when the final operation is a shear, the amount of bending thus induced may be sufficient to interfere with the final shearing operation. Thus, whenever work is effected in an offset position, there is obtained, to a lesser or greater degree, this type of bending due to the offset loading. As a result, when pressure is applied to the work piece, a bending moment is engendered in the supporting columns tending to cause them to bend as shown in FIG. 1. When the tool means extends beyond the press as illustrated, the bending moment is augmented. When the available material for constructing the tie rod-supporting columns is distributed into hollow columns, as illustrated in FIG. 2, resistance to the bending moment induced by offset loading is significantly increased.

Figure 6:
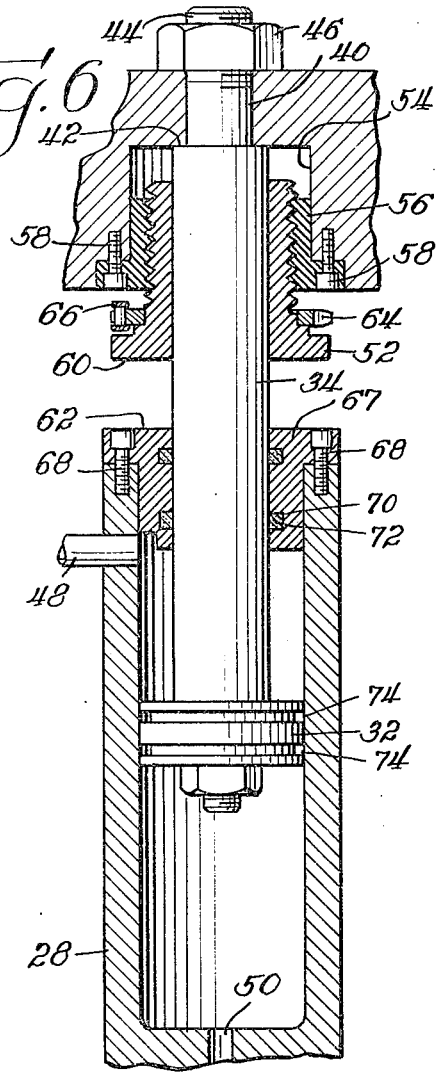
FIG. 6 is a fragmentary view in section, taken along line 6—6 of FIG. 5.
Figure 7:
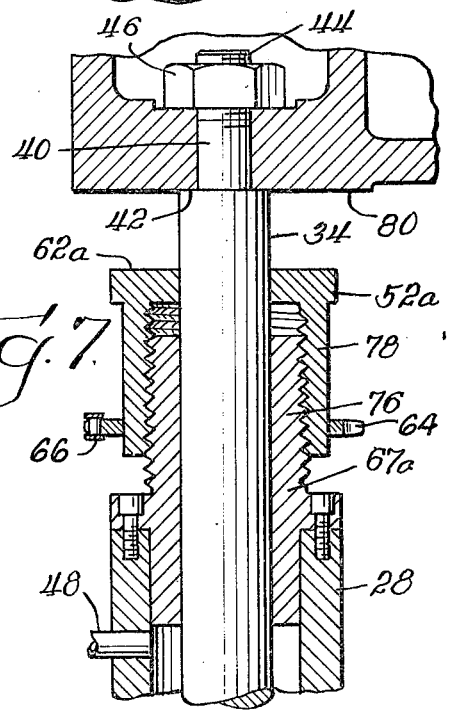
FIG. 7 is a fragmentary view in section of a modified form of the construction shown in FIG. 6.

In accordance with a preferred embodiment of the invention, this desideratum is most effectively obtained when the supporting tie columns 16 comprise the cylinders 28 of a pressure fluid-actuated means 30 comprising cooperating cylinders 28, pistons 32, and piston rods 34. The base 36 of the cylinders is rigidly affixed to the base member 10 by means of bolts 38 or other suitable fastening means and the free end 40 of the piston rod 34 is rigidly affixed to the crown member 12 as shown in FIGS. 6 and 7. The free end 40 is turned down to a smaller diameter than the piston rod proper, leaving a shoulder 42 which abuts against the surface of the crown member 12. The free end is threaded at 44 and projects through the crown member 12 and rigidly affixed thereto by means of the nut 46. Thus, when the piston rods are actuated to their extended position, the crown member is lifted. When they are actuated to their retracted position, the crown member is lowered and held at its working station.

The cylinders 28 (columns 16) may have any desired cross-section. Advantageously, however, the cross-section is that of a right polygon which in its simpler form is an equilateral triangle or a square, and which in its ultimate form is a circle. Advantageously, the cross-section is that of a square as this gives maximum effective utilization of material and optimum access to the press either longitudially or transversely.

The cylinders 28 are provided with inlet and outlet ports 48 and 50. These inlet-outlet ports serve to admit pressure fluid under pressure either to the top or to the bottom of the piston 32. As fluid is admitted to the top of the cylinder, it is exited from the bottom part and vice versa. Control means, not shown, determines when and where the pressure fluid is admitted and exited and the circuits to the several cylinders are integrated so that all the piston rods move in unison. Thus, when fluid under pressure is admitted to the bottom of the cylinders 28, all the pistons move in unison toward the extended position and thus raise the crown member 12 from its working station.

In order to predetermine and adjust the working station, adjustable stop means are provided for limiting the movement of the crown member toward the base member. One such adjustable stop means comprises a collar 52 affixed to the crown member 12 and adjustable relative thereto. The piston rod projects through this collar with a sliding fit therewith and is affixed to the crown member. The adjustment of the stop means, suitably, can be effected by threading the collar into the crown member 12. Thus, the crown member 12 may have a recess 54 adapted to receive the free end of the piston rod 34 as shown in FIG. 6. In this recess is mounted a sleeve 56 having female threads complementary to male threads on the collar. The sleeve is fastened into the crown member by suitable fastening means 58. Thus, by rotating the collar 52 one way, the collar moves into the recess 54 and by rotating it the other way, it moves out of the recess 54. The collar 52 and the cylinder 28 have complementary surfaces 60 and 62 adapted to abut when the piston rod is at its retracted position. In fact, it is the abutting of the surface 60 on the surface 62 which limits the inward movement of the piston rod 34. By rotating the collar 52 one way or the other, the extent of the inward movement of the piston rod 34 can be adjusted upwardly or downwardly, and in turn the position of the crown member 12 at its work station is adjusted upwardly and downwardly.

To coordinate the adjustment of the collars 52, each collar is provided with a sprocket 64 and the several sprockets are all linked together by a common chain 66 so that movement imparted to any one collar imparts the same degree of movement to each and every other collar. The member 82 are guards located in front of the chain 66.

The abutting surface 62 of the cylinder comprises the cylinder head 67 which is fastened to the cylinder by suitable fasteners 68. The cylinder head is provided with suitable packing glands 70 filled with suitable packing material 72. The piston 32 also has packing glands 74 which are filled with suitable packing material, not shown.

In the modified form shown in FIG. 7, the collar **52*a* is mounted on the cylinder 28 and is adjustable to and away from the top of that cylinder. To accomplish this, the cylinder head 67*a* is provided with a threaded extension 76 having male threads which are complementary with female threads in a depending annular flange 78, depending from the collar 52*a*. By rotating the collar one way, the collar is moved away from the top of the cylinder head and by rotating it the other way, it is moved toward the top of the cylinder head. The cylinder head may have packing glands and packing as in FIG. 6 and the collars may be provided with sprockets and the common chain as in FIG. 6. In this modification, the recess 54 is not needed so that the shoulder 42 of the piston rod abuts a flat surface 80 at the bottom of the crown member 12 which abuts the upper surface 62*a* of the crown 52*a* when the piston rod is at the limit of its inward throw, which are in FIG. 6 is determined by the position of the collar 52. In both modifications of FIGS. 6 and 7, the collar and the top of the piston have essentially the same size and shape so that when the collar rests on the top of the cylinder 62 or against the surface 80**, the collar and the pistons have substantially the appearance of a single column reaching from the base member to the crown member.

When the pistons are activated to retracted position, the piston rods hold the crown firmly and securely at its working position, with the crown member 12 through the surface 60 or 80 pressing down upon the surface 62 or **62*a*, respectively. This holds the cylinder head tightly with a downwardly-directed force which is equal to and opposite to upwardly-directed force engendered by the pressure in the cylinder. Thus, the pressure in the upper portion of the cylinder may be increased as needed to hold the crown member 12** firmly in working position without danger of blowing the cylinder head.

Figure 3:
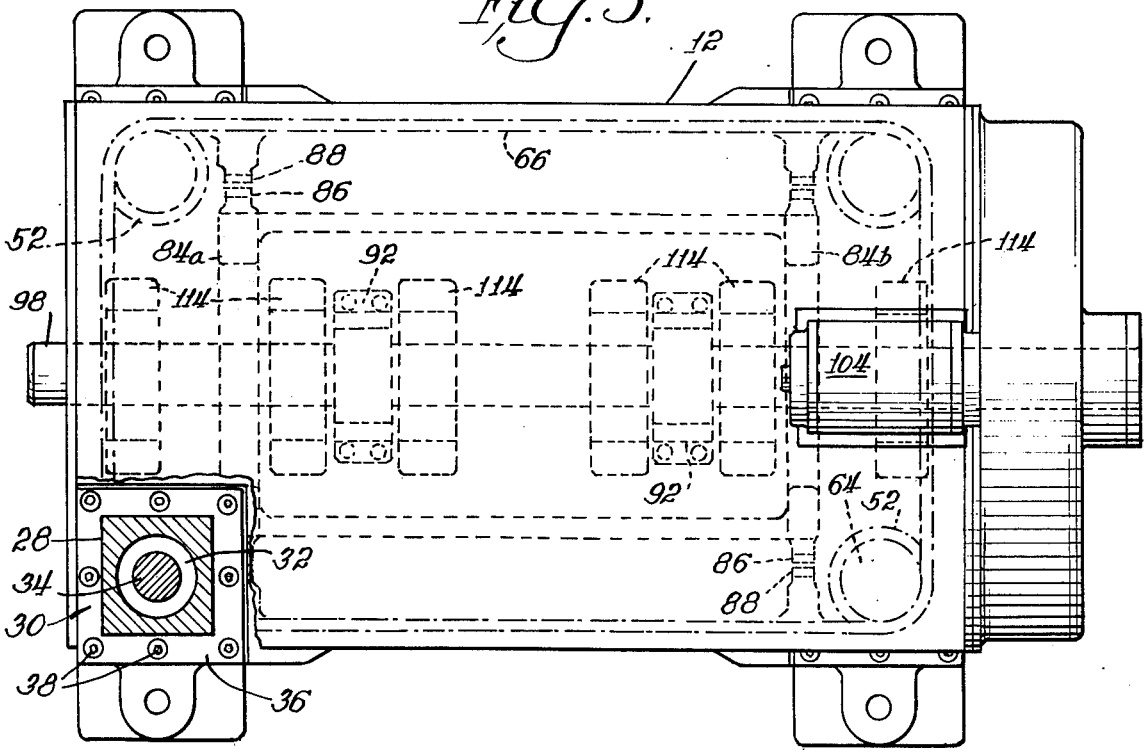
FIG. 3 is a plan view of one modification of the invention, with parts in section taken along lines 3—3 of FIG. 4.
Figure 4:
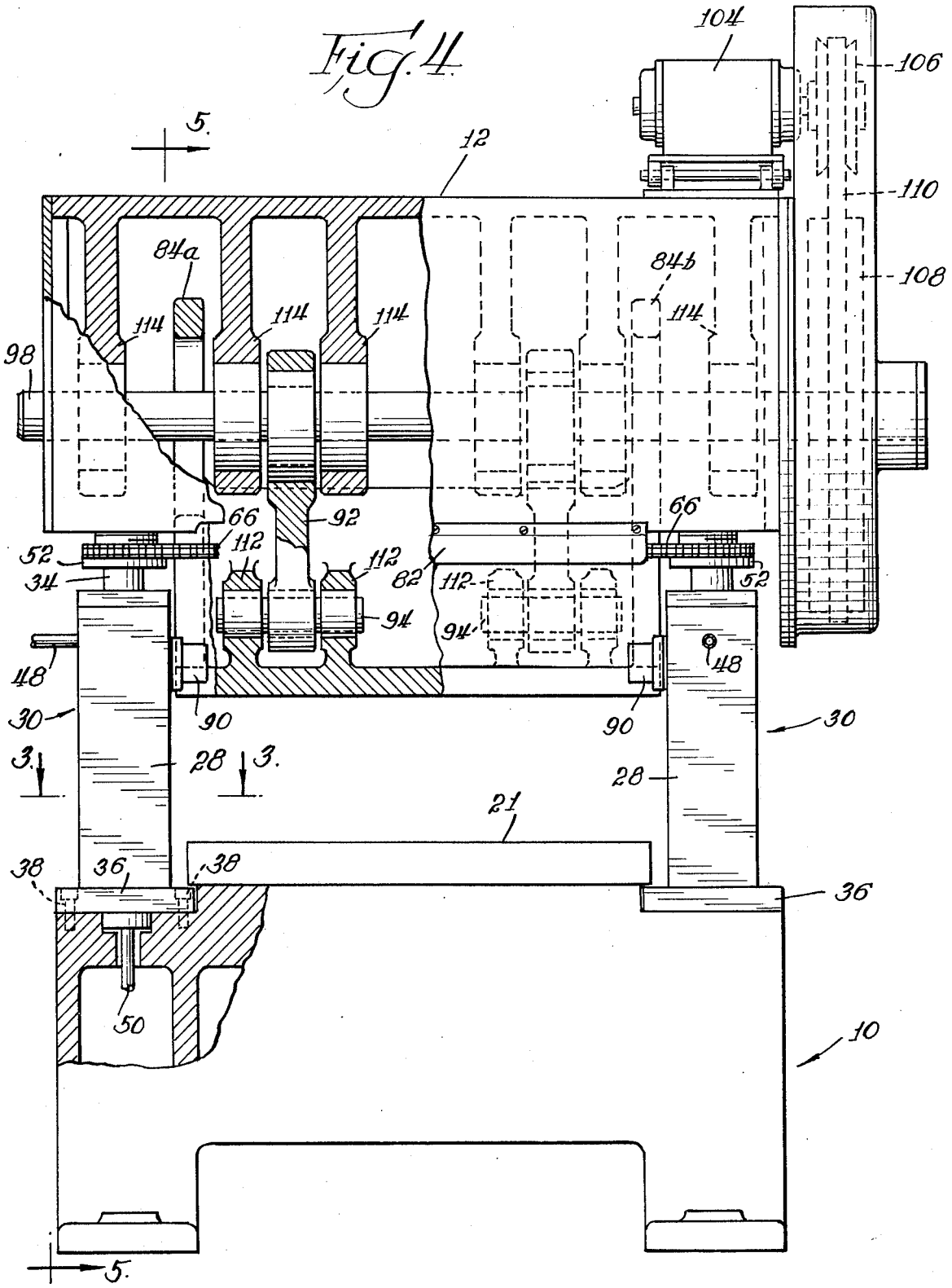
FIG. 4 is a side elevation of FIG. 3, parts being in sections along the center line or axis of the press.
Figure 5:
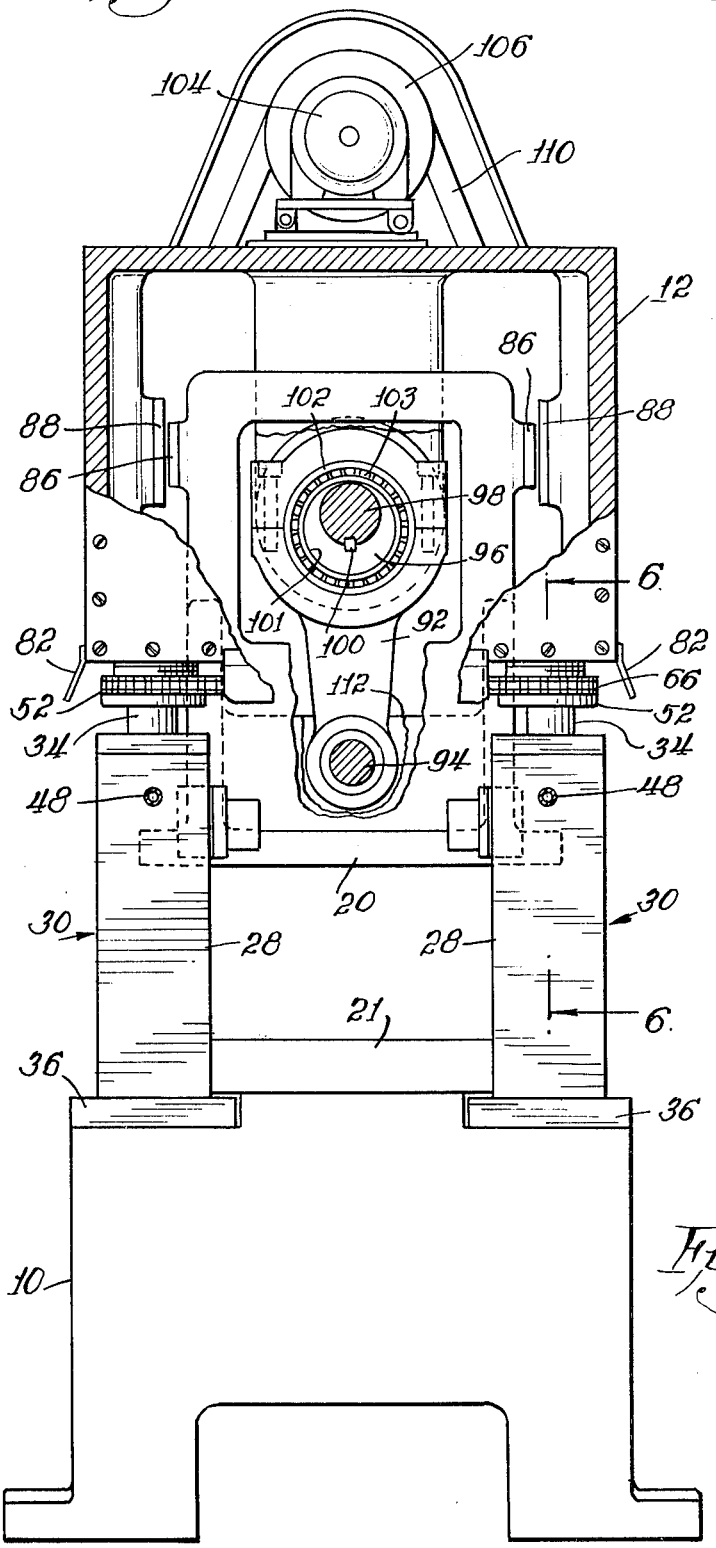
FIG. 5 is an end view of FIG. 3, with parts broken away and parts in section at line 5 of FIG. 4.

The upper bolster 20 is reciprocated toward and away from the lower bolster 21 by means of an operative press ram. In the modification in FIGS. 3, 4, and 5, this is effected by means of a yoke 84 adapted to reciprocate vertically in the crown member 12. The yoke comprises one transverse member **84*a* attached to one end of the pressure plate 20 and corresponding transverse member 84*b* attached to the other end of the pressure plate 20 and each is provided with guide roller assemblies 86 (illustrated diagramatically only), which is adapted to roll against wear plates 88. It is also provided with roller guide means 90 adapted to engage the inner surfaces of the cylinders 28. If desired, the inner surfaces of the cylinders 28 may be provided with wear plates, not shown, for the roller to roll upon. Thus, the yoke and the bolster 20** is constrained to move up and down in the press. The up and down movement of the bolster and the yoke is effected by the connecting rod 92 connecting the pins 94 and the cams 96 which are carried by the drive shaft 98 and affixed thereto by keys 100. Between the connecting rods and the cams 96 are roller bearing or ball bearing assemblies comprising inner and outer races 101 and 102 and cage 103. Similar bearings 95 are also provided between the connecting rods 92 and the pins 94. The pins 94 are journalled in plates 112 projecting from the upper surface of the pressure plate 20 and rigidly affixed thereto. The drive shaft 98 is driven by motor 104 through the pulley 106 and flywheel 108 and belt 110.

The drive shaft 98 is journalled in a number of bearings forming an integral or unitary part of the crown member 12. There is provided one such bearing at each end of the crown member and one such bearing on each side of each cam. The bearings may be provided with roller-bearing or ball-bearing races similar to those between the connecting rod 92 and the cams 96.

Figure 8:
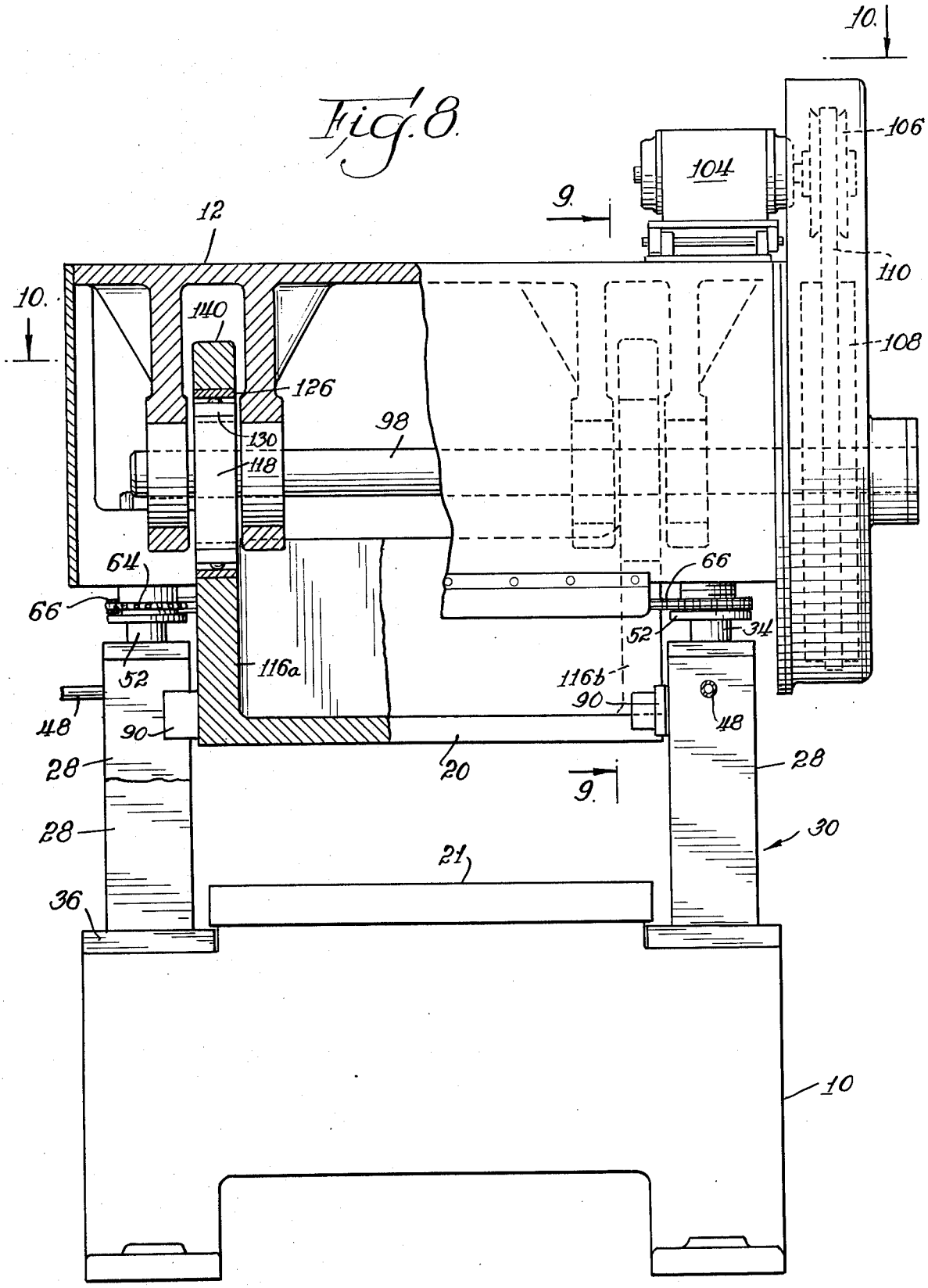
FIG. 8 is a side elevation in partial section of a modified form of the invention.
Figure 9:
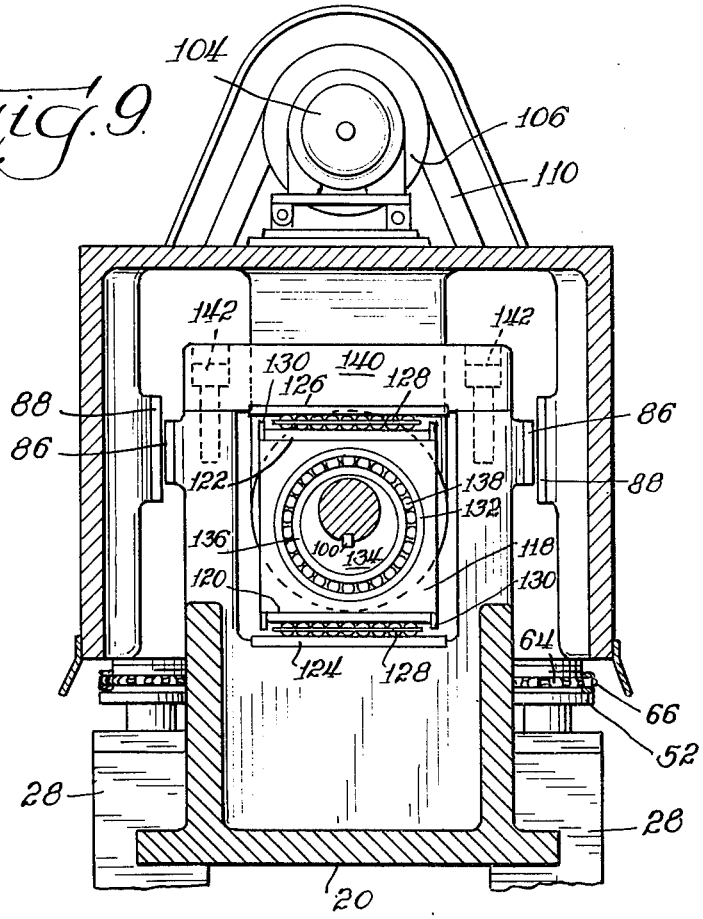
FIG. 9 is an end view in section, taken along line 9—9 of FIG. 8.
Figure 10:
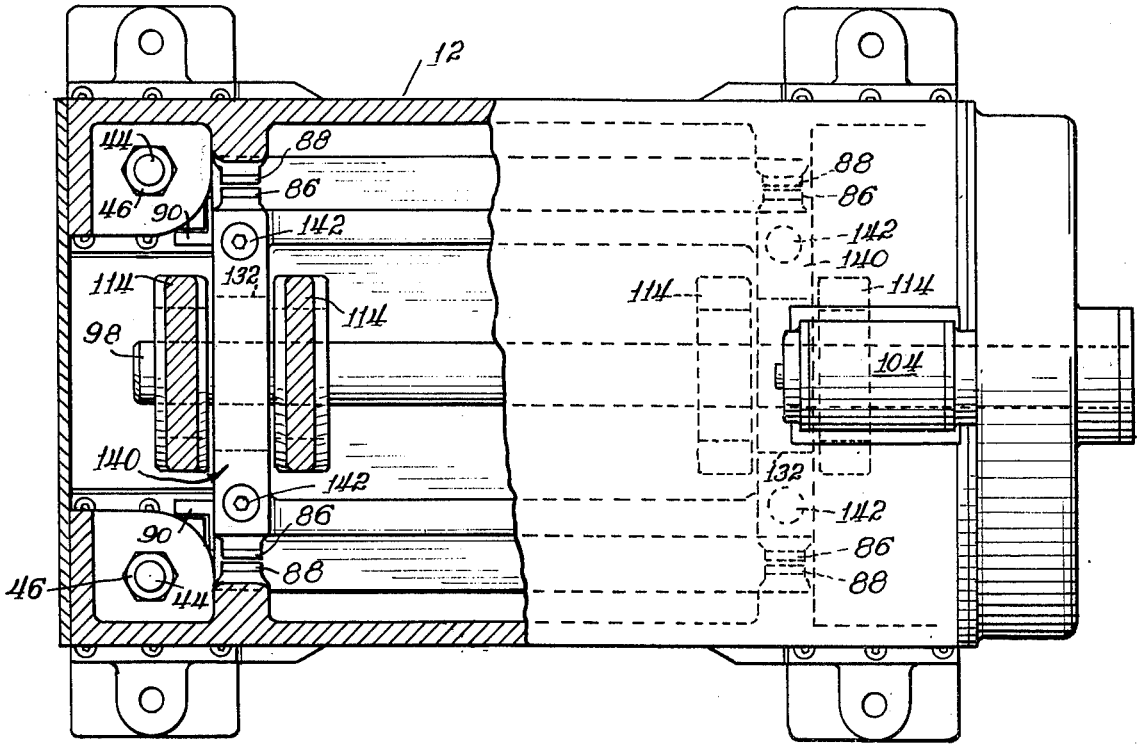
FIG. 10 is a plan view in partial section, taken along line 10—10 of FIG. 8.
Figure 11:
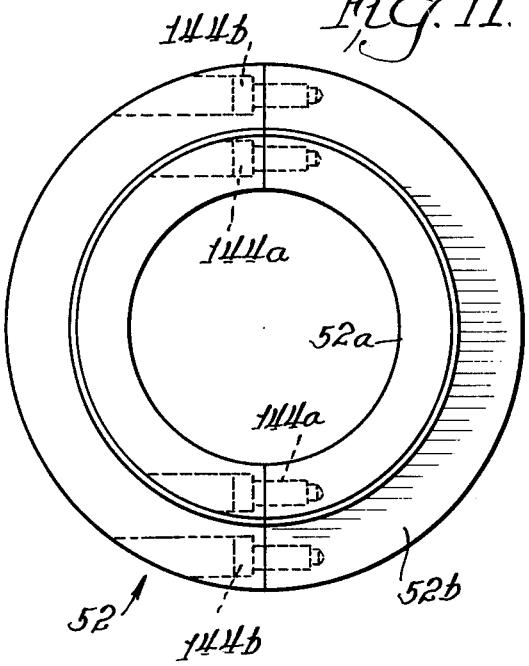
FIG. 11 is a plan view of a modified form of a collar.
Figure 13:
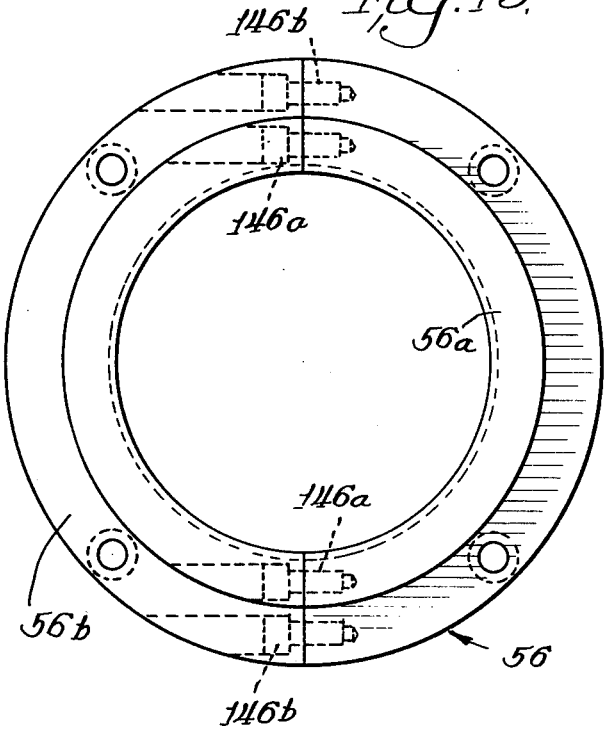
FIG. 13 is a plan view of a modified form of a sleeve.
Figure 12:
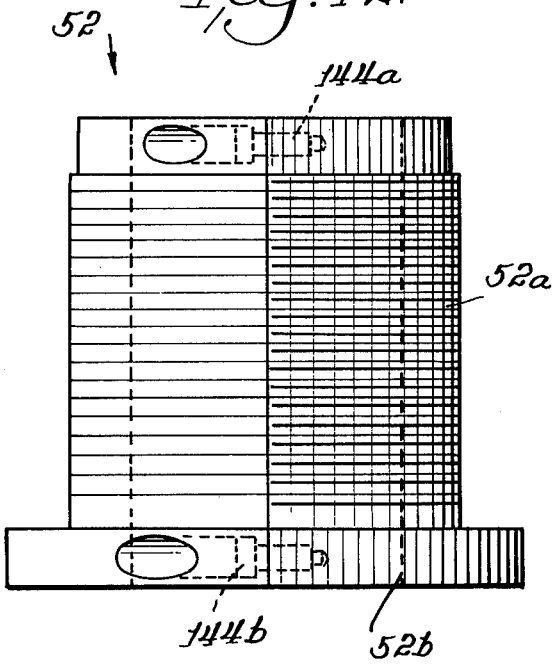
FIG. 12 is a side elevation of FIG. 11.
Figure 14:
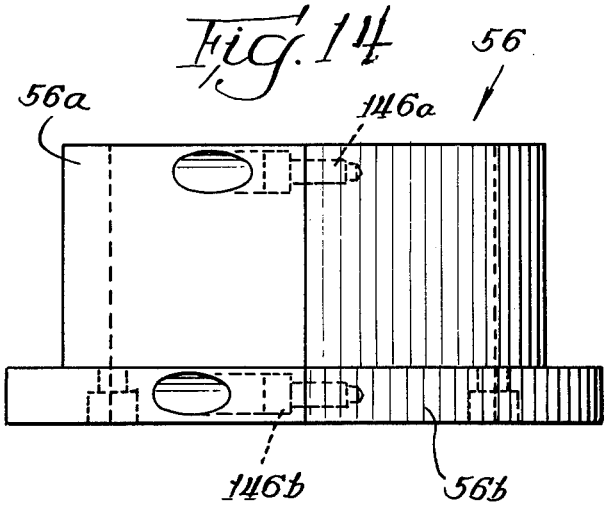
FIG. 14 is a side elevation of FIG. 13.

In FIGS. 8, 9, and 10 there is shown a modified form as the overall construction is the same as in FIGS. 3, 4, 5, 6, and 7. Like parts will be designated by like reference numerals and will not be further described. The essential difference between the two modifications is in the construction of the operative press ram means. Attached to each end of the pressure plate 20 are the two legs 116*a* and 116*b* of the yoke. Each is provided with guide roller assemblies 86 which roll up and down on the wear plates 88, as in the other modifications. Also, each is provided with roller guide means 90 as in the other modification, thereby confining the yoke to vertical reciprocal movement. Each of the yoke members 16*a* is provided with sliding blcok 118 having flat horizontal bearing surfaces or races 120 at the bottom and 122 at the top. Each yoke has complementary horizontal bearing surfaces or races 124 and 126. Between the complementary bearing surfaces 120 and 124, and 122 and 126, there are bearing cages 128. The bearings may be either ball bearings or roller bearings. At the ends of the bearing plates 120 and 122 are stops 130 to keep the bearing cages 128 in operative relation to the block 118.

The block 118 has a central circular bearing assembly comprising bearing cages 138 between the concentric bearing races 132 and 136. Cam 134 mounted on the drive shaft and fixed thereto by means of the key 100 is surrounded by the inner bearing race 136. Each yoke 116*a* and 116*b* has a removable cross head 140 fastened to the yoke proper by bolts 142 or other suitable fastening means. If desired, the roller assemblies 86 can be mounted on opposite ends of the cross head 140. As the shaft 98 is rotated the cam 134 causes the block 118 to oscillate back and forth and up and down, thereby imparting an up and down motion to the yokes 116*a* and 116*b* and the pressure plate 20.

Referring now to FIGS 11, 12, and 13, and 14, there is shown a modified form of the collar 52 and sleeve 56. Both the collar and the sleeve are split into two halves. The two halves are fastened together by bolts 144 and 146 which are counter-set into one half and threaded into the other. The bolts 144*a* and 146*a* are counter-set and threaded in the sleeve portions 52*a* and 56*a* of the collar 52 and sleeve 56, respectively, and the bolts 144*b* and 146*b*, similarly, are counter-set and threaded in the flange portions 52*b* and 56*b*, respectively. This split-ring construction makes it possible to remove the collars and sleeves for replacement without having to disconnect the piston rods.

Advantageously, the split collars and sleeves are formed by fastening two solid blocks together with the bolts 144 and 146 and machining the blocks into the desired collars and sleeves. In this way, the same degree of precision is obtained as if the collars and sleeves were not split.

In operation of the device, the crown 12 is raised to the position shown in FIGS. 4, 5, 8, and 9, or to a higher position if desired, to provide space between the pressure plate 20 and lower bolster 21. Then the control means is actuated to withdraw pressure fluid from the bottom of the cylinders and introduce a complementary amount of pressure fluid into the upper part of the cylinders in order to effect lowering of the crown 12. This lowering may be effected rapidly or slowly according to how the controls are set and in accordance with the size of the outlet-inlet 50. As the pressure fluid is exited through outlet-inlet 50, the piston 34 gradually drops toward its inward throw position and when it reaches that position, the surface 60 abuts surface 62, or surface 62*a* abuts surface 80, and the crown is then seated on the supporting cylinders 28 and held there by the pressure of the pressure fluid admitted into the upper part of the cylinder through inlet-outlet 48. If hydraulic or non-compressible fluid is used, the crown becomes absolutely immovable with respect to the base. If a compressible fluid is used, the crown becomes immovable with respect to the base up to the point where the pressure engendered by the press operation counterbalances the presssure in the cylinder. In either case, if desired, overload devices may be provided so that, when the pressure engendered by the operation on the workpiece becomes excessive, the pressure in the upper part of the cylinder is relieved, allowing the crown member 12 to rise and relieve the pressure engendered on the workpiece.

The piston rod 34 has a relatively large diameter in order to be able effectively to support the weight of the crown member 12. Advantageously, the cross-sectional area of the piston rod is at least one-third of the cross-sectional area of the piston. Also, advantageously, the cylinder head 67 has a relatively large axial dimension so that, when the piston rod is fully extended and the piston abuts the cylinder head, the piston will be far enough below the top of the cylinder head to provide a rigid column. Advantageously, for this purpose, the axial dimension of the cylinder head is at least equal to the diameter of the piston rod and, preferably, the axial dimension of the cylinder head plus the axial dimension of the piston is equal to at least about the diameter of the bore of the cylinder.

Advantageously, also, the cylinder is relatively large, both inside and outside and should have a length to minimum breadth ratio of not greater than 5, advantageously, between about 3 and 4. Also, the diameter of the bore should be at least two-thirds, and preferably not more than seven-eighths, of the minimum transverse dimension of the cylinder.

It is to be understood that the invention is not to be limited to the exact details of operation or structure shown and described as obvious modifications and equivalents will be apparent to one skilled in the art.

I claim:

1. In a press having a crown member, a complementary base member, operative press ram means operating between said crown member and base member to apply work pressure to a workpiece in direct or offset loading positions, and support and tiedown means adapted rigidly to hold said crown member at a predetermined working station with respect to said base member, the improvement in which the support and tiedown means comprises hollow columns which are the cylinders of pressure fluid-actuated means, each comprising a cylinder and cooperating piston and piston rod and cylinder head, said pressure fluid-actuated means having the base of each cylinder rigidly affixed to one of said members and the free end of each piston rod rigidly affixed to the other of said members, and being integrated for concurrent and equal action, and cooperating pressure fluid inlet and outlet means and pressure fluid controls for effectively altering the pressure on either side of the pistons, whereby when the piston rods are actuated toward their extended position, the crown member is moved away from the base member and when the piston rods are actuated toward their retracted position, the crown member is moved toward the base member, and stop means for limiting the movement of said crown member toward said base member, whereby when the piston rods are moved to their retracted position, the crown member is held in a fixed rigid position relative to the base member.

2. The press of claim 1, in which the stop means comprises a collar adapted to transfer the weight of the crown member to the cylinder head.

3. The press of claim 2, in which the collar has a diameter substantially equal to the minimum diameter of the cylinder head.

4. The press of claim 2, in which the collar is affixed to the member to which the piston rod is affixed, is adjustable relative thereto, and has a surface adapted to abut the top of the cylinder head.

5. The press of claim 4, in which the collar has a diameter substantially equal to the minimum diameter of the cylinder head.

6. The press of claim 2, in which the collar is affixed to the cylinder head, is adjustable to and away therefrom, and has a surface adapted to abut the member to which the piston rod is attached.

7. The press of claim 6, in which the collar has a diameter substantially equal to the minimum diameter of the cylinder head.

8. The press of claim 1, in which the cylinders are square, are located at each of four corners of the press, and are oriented so that one side of each column lies in a plane that is common with it and one side of another column.

9. The press of claim 1, in which the cylinders have a ratio of length to breadth not greater than 5.

10. The press of claim 1 in which the cylinders have a ratio of length to breadth of about 3 to about 4.

11. The press of claim 1, in which the bore of the cylinders has a diameter between about two-thirds and about seven-eighths that of the cylinder.

12. The press of claim 11, in which the cylinders have a ratio of length to breadth not greater than 5.

13. The press of claim 11, in which the cylinders have a ratio of length to breadth of about 3 to about 4.

14. The press of claim 11, in which the cylinders are square, are located at each of four corners of the press, and are oriented so that one side of each column lies in a plane that is common with it and one side of another column

15. The press of claim 1, in which the piston rod has a cross -sectional area at least equal to about one-third of the cross-sectional area of the piston.

16. The press of claim 1, in which the axial dimension of the cylinder head is at least equal to the diameter of the piston rod.

17. The press of claim 1, in which the axial dimension of the cylinder head plus the diameter of the piston rod is at least equal to about the inside diameter of the cylinder.

18. The press of claim 1 in which the cylinders have a ratio of length to breadth not greater than 5;

the bore of the cylinders has a diameter between about two-thirds and seven-eighths that of the cylinder;

the stop means comprises a collar adapted to transfer the weight of the crown member to the cylinder head;

the collar has a diameter substantially equal to the minimum diameter of the cylinder head.

the collar is affixed to the member to which the piston rod is affixed, is adjustable relative thereto, and has a surface adapted to abut the top of the cylinder head;

the piston rod has a cross-sectional area at least equal to about one-third of the cross-sectional area of the piston; and the axial dimension of the cylinder head is at least equal to the diameter of the piston rod.

19. The press of claim 1, in which the cylinders have a ratio of length to breadth not greater than 5;

the bore of the cylinders has a diameter between about two-thirds and seven-eighths that of the cylinder;

the stop means comprises a collar adapted to transfer the weight of the crown member to the cylinder head;

the collar has a diameter substantially equal to the minimum diameter of the cylinder head;

the collar is affixed to the cylinder head, is adjustable to and away therefrom, and has a surface adapted to abut the member to which the piston rod is attached;

the piston rod has a cross-sectional area at least equal to about one-third of the cross-sectional area of the piston; and the axial dimension of the cylinder head is at least equal to the diameter of the piston rod.

20. In a press having a base member and a crown member vertically movable with respect to each other and means for bringing said crown member to and holding it at a predetermined work station at a predetermined distance above said base member and moving it away from said base member to provide working space betwen the two said members; upper and lower pressure plates carried by said crown member and said base member, respectively; operative press ram means carried by said crown member adapted to effect reciprocal movement of said upper pressure plate toward and away from said lower pressure plate to effect work upon a workpiece by means of a tool, complementary portions of which are respectively supported on said upper and lower pressure plates; adjustable stop means for determinging the distance at which said crown member will be held at said predetermined work station; the improvement which comprises :

a plurality of pressure fluid-actuated means disposed between said base member and said crown member comprising a plurality of spaced cylinders having cooperating pistons and piston rods, and cylinder heads;

the base of said cylinders being rigidly affixed to said base member and the free ends of said piston rods being rigidly affixed to said crown member;

each of said cylinders being parallel to each other of said cylinders and normal to said members;

said plurality of pressure fluid-actuated means being integrated for concurrent and equal action; and cooperating pressure fluid inlet and outlet means and pressure fluid controls for effectively altering the pressure on either side of the pistons in said pressure fluid-actuated means for effecting movement of said members toward and away from each other, and at the end of the former movement, holding said crown member at said predetermined work station;

said pressure fluid-actuated means forming a plurality of parallel, vertically-disposed columns for supporting said crown member with respect to said base member ;

said stop means being effective to limit the inward throw of said piston rods; and said pressure fluid-actuated means being operative to hold the piston rods at the limit of their inward throw, immovable against the pressure applied to the workpiece by the operative press ram means.

21. The press of claim 20, in which the cylinders have a ratio of length to breadth not greater than 5.

22. The press of claim 21, in which the cylinders have cross-sections of concentric right polygons and in which the inside diameter is between about two-thirds and about seven-eighths of the outside diameter.

23. The press of claim 20, in which the cylinders have a ratio of length to breadth between about 3 and a bout 4.

24. The press of claim 23, in which the cylinders have cross-sections of concentric right polygons and in which the inside diameter is between about two-thirds and about seven-eights of the outside diameter.

25. The press of claim 20, in which the cylinders have cross-sections of concentric right polygons and in which the inside diameter is between about two-thirds and about seven eights of the outside diameter.

26. The press of claim 20, in which the adjustable stop means comprises a collar adapted to transfer the weight of the crown member to the cylinder head.

27. The press of claim 26, in which the collar has a diameter substantially equal to the minimum diameter of the cylinder head.

28. The press of claim 26, in which the collar is affixed to the crown member, is adjustable relative thereto, and has a surface adapted to abut the cylinder head.

29. The press of claim 28, in which the cylinders have cross-sections of concentric right polygons and in which the inside diameter is between about two-thirds and about seven eighths of the outside diameter.

30. The press of claim 26, in which the collar is affixed to the cylinder head, is adjustable to and away therefrom, and has a surface adapted to abut the crown member.

31. The press of claim 30, in which the cylinders have cross-sections of concentric right polygons and in which the inside diameter is between about two-thirds and about seven eighths of the outside diameter.

32. The press of claim 20, in which the piston rod has a cross-sectional area at least equal to about one-third of the cross-sectional area of the piston.

33. The press of claim 20, in which the axial dimension of the cylinder head is at least equal to the diameter of the piston rod.

34. The press of claim 20, in which the axial dimension of the cylinder head plus the diameter of the piston rod is at least equal to about the inside diameter of the cylinder.

35. The press of claim 20, in which the cylinders have a ratio of length to breadth between about 3 and about 4;

the inside and outside of the hollow columns have cross-sections of concentric right polygons in which the inside diameter is between about two-thirds and about seven-eighths of the outside diameter;

the adjustable stop means comprises a collar adapted to transfer the weight of the crown member to the cylinder head;

the collar has a diameter substantially equal to the minimum diameter of the cylinder head;

the collar is affixed to the crown member, is adjustable relative thereto, and has a surface adapted to abut the cylinder head;

the inside and outside of the hollow columns have cross-sections of concentric right polygons in which the inside diameter is between about two-thirds and about seven-eighths of the outside diameter;

the piston rod has a cross-sectional area at least equal to about one-third of the cross-sectional area of the piston; and the axial dimension of the cylinder head plus diameter of the piston rod is at least equal to about the inside diameter of the cylinder.

36. The press of claim 20, in which the cylinders have a ratio of length to breadth between about 3 and about 4;

the inside and outside of the hollow columns have cross-sections of concentric right polygons in which the inside diameter is between about two-thirds and about seven-eighths of the outside diameter;

the adjustable stop means comprises a collar adapted to transfer the weight of the crown member to the cylinder head;

The collar has a diameter substantially equal to the minimum diameter of the cylinder head;

the collar is affixed to the cylinder head, is adjustable to and away therefrom, and has a surface adapted to abut the crown member;

the piston rod has a cross-sectional area at least equal to about one-third of the cross-sectional area of the piston; and the axial dimension of the cylinder head plus the diameter of the piston rod is at least equal to the inside diameter of the cylinder.

37. In a press having a crown member, a complementary base member, operative press ram means operating between said crown member and base member to apply work pressure to a workpiece in direct or offset loading positions, and support and tiedown means adapted rigidly to hold said crown member at a predetermined working station with respect to said base member, the improvement in which the support and tiedown means comprises hollow columns which comprise pressure fluid-actuated means, each comprising a cylinder and cooperating piston and piston rod and cylinder head and stop means for limiting the movement of said crown member toward said base member, said pressure fluid-actuated means having each cylinder rigidly a part of one of said members and the free end of each piston rod rigidly affixed to the other of said members, and being integrated for concurrent and equal action, and cooperating pressure fluid inlet and outlet means and pressure fluid controls for effectively altering the pressure on either side of the pistons, whereby when the piston rods are actuated toward their extended position, the crown member is moved away from the base member and when the piston rods are actuated toward their retracted position, the crown member is moved toward the base member and held in a fixed rigid position relative to the base member.

* * * * *

UNITED STATES PATENT OFFICE

CERTIFICATE OF CORRECTION

Patent No. 4,024,807 Dated May 24, 1977

Inventor(s) Douglas E. Karsen

It is certified that error appears in the above-identified patent and that said Letters Patent are hereby corrected as shown below:

Col. [57[, Line 24; Change "a relative' to read --- a relatively ---

Col. 1, Line 42; Change "against th" to read --- against the ---

Col. 1, Line 58; Change "multiples" to read ---multiplies ---

Col. 3, Line 18; Change "moveable" to read ---movable---

Col. 5, Line 27; Change "longitudially" to read ---longitudinally---

Col. 6, Line 6; Change "member 82" to read ---members 82 ---

Col. 6, Line 32; Change "which are" to read -- which as ---

Col. 7, Line 28; Change "modifications" to read ---modification---

Col. 7, Line 32; Change "sliding blcok" to read ---sliding block ---

Col. 7, Line 56; Change "FIGS 11, 12, and 13, and 14" to read ---FIGS. 11,12, 13 and 14,---

Col. 9, Line 52; Change "claim 1 in" to read ---Claim 1, in ---

Col. 9, Line 65; Change "column" to read ---column.---

Col. 10, Line 8; Change "claim 1 in " to read ---Claim 1, in---

Col. 10, Line 52; Change "betwen" to read ---between---

UNITED STATES PATENT OFFICE

CERTIFICATE OF CORRECTION

Patent No. 4,024,807 Dated May 24, 1977

Inventor(s) Douglas E. Karsen Page 2 of 2

It is certified that error appears in the above-identified patent and that said Letters Patent are hereby corrected as shown below:

Col. 10, Line 61: Change "determinging" to read
---determining---

Col. 11, Line 33-34; Change "and a bout 4." to read
---and about 4.---

Col. 11, Line 42; Change "seven eights" to read
---seven-eights---

Col. 11, Line 56; Change "seven eights" to read
---seven-eights---

Col. 11, Line 65; Change "seven eights" to read
---seven-eights---

Col. 12, Line 46; Change "The collar" to read ---the collar---

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*